United States Patent [19]

Patalon

[11] Patent Number: 4,629,417

[45] Date of Patent: Dec. 16, 1986

[54] PROCESS AND FURNACE FOR REHEATING SLABS, BILLETS, BLOOMS AND THE LIKE

[75] Inventor: Heinrich Patalon, Bochum, Fed. Rep. of Germany

[73] Assignee: Didier Engineering GmbH, Essen, Fed. Rep. of Germany

[21] Appl. No.: 785,776

[22] Filed: Oct. 9, 1985

[30] Foreign Application Priority Data

Nov. 23, 1984 [DE] Fed. Rep. of Germany ..... 3442707

[51] Int. Cl.[4] ..... F27D 5/00; F26B 3/00; F23M 7/00; F27B 9/02

[52] U.S. Cl. ..... 432/5; 34/38; 110/173 A; 432/128

[58] Field of Search ..... 432/5, 10, 11, 128, 432/132; 34/38; 110/173 A; 266/249, 258, 261

[56] References Cited

U.S. PATENT DOCUMENTS

| | | | |
|---|---|---|---|
| 295,667 | 3/1884 | Myers | 34/38 |
| 903,511 | 11/1908 | Schmidt et al. | 266/249 |
| 1,698,367 | 1/1929 | Kehren | 110/173 A |
| 3,226,101 | 12/1965 | Balaz et al. | 266/249 |
| 3,553,414 | 1/1971 | McArthur | 266/249 |
| 4,170,815 | 10/1979 | Tokitsu | 432/5 |

FOREIGN PATENT DOCUMENTS

| | | | |
|---|---|---|---|
| 3248234 | 7/1984 | Fed. Rep. of Germany | 432/122 |
| 1010419 | 11/1965 | United Kingdom | 266/261 |

OTHER PUBLICATIONS

Research Bulletin #6 West Coast Lumber Seasoning, The Wind Tunnel Lumber Dryer, Apr. 1946.

*Primary Examiner*—John J. Camby
*Attorney, Agent, or Firm*—Peter K. Kontler

[57] ABSTRACT

A reheating furnace has a row of heating chambers and a mobile roof whose sections can be moved relative to each other so as to expose the tops of selected chambers for admission or evacuation of slabs. The slabs are lowered into and lifted out of selected heating chambers by an elevator which is mounted on tracks at a level above the motors for carriages which shift the roof sections relative to the chambers. Each chamber can be heated by a set of burners independently of the other chambers. The elevator stacks the slabs in such a way that one marginal portion of each slab is exposed for pronounced heating by combustion products and the other marginal portion is nested between and is heated by the neighboring slabs.

19 Claims, 6 Drawing Figures

1
2
2a
2b
2c
3
4
5
6
7
8
9
10
11
12
13
14
18
23
24
25
27
29

20
15
26
2
16
16
17
17
4
4
4
4
4
4
1
1
1
1
1
1
3
21
5
11
2
18
19
23
I
22
II
5
I'
29

PROCESS AND FURNACE FOR REHEATING SLABS, BILLETS, BLOOMS AND THE LIKE

CROSS-REFERENCE TO RELATED CASE

The reheating furnace which is disclosed in the present application is somewhat similar to the furnace which is disclosed in the commonly owned copending patent application Ser. No. 785,777 filed Oct. 9, 1985 for "Process and furnace for reheating metallic objects".

BACKGROUND OF THE INVENTION

The present invention relates to a process for heating slabs, billets, blooms and like metallic objects, and to a furnace which can be utilized for the practice of the process. More particularly, the invention relates to improvements in reheating furnaces and to a process for treating metallic objects in such furnaces.

The trend in the steel industry is toward increased synchronization between continuous casting machines and rolling mill trains. This renders it possible to admit slabs, blooms, billets and like objects which issue from a continuous casting machine directly into a rolling mill train or to admit such objects into the reheating furnace in a condition in which they require a minimum of reheating, i.e., the temperature of each object should be relatively high at the time the object enters the reheating furnace. The result is a pronounced reduction of energy requirements for reheating of the objects prior to introduction into a rolling mill.

The above outlined prerequisites can be met only if the construction and mode of operation of a reheating furnace are attuned to the requirements of the machines which supply the objects as well as to the requirements of machines which process the objects subsequent to reheating. Thus, a modern reheating furnace should be capable of reheating cold objects as well as of merely increasing or reducing the temperature of an object which is delivered at a temperature below or at a temperature above the optimum rolling temperature, e.g., at a temperature between 1100° and 1260° C. In addition, a modern reheating furnace should be capable of storing a certain number of objects so as to take into account potential fluctuations in the output of a continuous casting machine and/or potential fluctuations in the requirements of a rolling mill train, i.e., of storing a certain number of objects when the output of the casting machine exceeds the requirements of the rolling mill train as well as of satisfying the requirements of the rolling mill train when the output of the casting machine drops below a standard value.

As a rule, a billet, a bloom or a slab must be heated primarily in the region which is adjacent to its external surface because the temperature of the cores of such objects deviates rather slightly from the optimum rolling temperature (it is normally between approximately 1100° and 1260° C.). Thus, only the stratum or strata which are close to the external surface of such an object are likely to undergo pronounced cooling during travel from the casting machine to the rolling mill train. For example, a slab comprises a core which constitutes the major portion of the slab and whose temperature is optimal for immediate rolling or such temperature even exceeds the optimal value so that only the relatively thin outer portion or stratum of the slab requires a reheating preparatory to admission into a rolling mill. The reheating furnace between the casting machine which turns out slabs and the rolling mill train must be designed with a view to ensure adequate heating of the outer stratum or strata of each slab but without overheating the core whose temperature already matches or very closely approximates the optimum rolling temperature.

OBJECTS AND SUMMARY OF THE INVENTION

An object of the invention is to provide an economic process for reheating billets, blooms, slabs and analogous metallic objects on their way to a processing station, particularly to a rolling mill.

Another object of the invention is to provide a process which can be used for simultaneous heating of numerous batches of metallic objects.

A further object of the invention is to provide a process which renders it possible to reuse gaseous heating fluids prior to their evacuation from a reheating furnace.

An additional object of the invention is to provide a novel and improved reheating furnace which can be utilized for the practice of the above outlined process.

Still another object of the invention is to provide a furnace wherein each of several batches of metallic objects can be treated independently of the other batch or batches in an economical and time-saving manner.

A further object of the invention is to provide novel and improved means for preventing the escape of hot gaseous fluids from a reheating furnace and novel and improved means for charging the furnace as well as for removing heated objects from the furnace.

Another object of the invention is to provide a system of reheating furnaces which can store large quantities of metallic objects intermediate a producing and a consuming or processing machine for extended intervals of time, in a small area and in optimum positions for removal from storage.

A further object of the invention is to provide a novel and improved combination of tandem heating chambers for utilization in a reheating furnace of the above outlined character.

An additional object of the invention is to provide a reheating furnace whose operation can be automated to any desired extent and wherein the conditions for treatment of different types of metallic objects can be altered within any desired practical range.

The invention resides in the provision of a process for operating a furnace, particularly a reheating furnace for slabs, billets, blooms and analogous bulky metallic objects. The process comprises the steps of establishing a plurality of discrete heating chambers, selecting and maintaining the temperature of each chamber independently of the other chamber or chambers (e.g., by causing a selected number of burners to discharge gaseous combustion products into the respective chambers), delivering objects into selected chambers from above, and lifting the heated objects out of the respective chambers. The objects can be delivered directly from a continuous casting machine.

The delivering step can comprise stacking the objects in at least one of the selected chambers so that each upper object partially overlies the object therebelow. For example, the objects can be arrayed in accordance with the so-called running header pattern which is known from the field of bricklaying. If the objects are elongated metallic slabs with pairs of longitudinally extending marginal portions, the arraying or stacking step can include accumulating slabs into piles wherein one longitudinally extending marginal portion of each oddly numbered slab extends laterally outwardly beyond the one longitudinal marginal portion of each adjacent evenly numbered slab and the other longitudinally extending marginal portion of each evenly numbered slab extends laterally beyond the other longitudinally extending marginal portion of each adjacent oddly numbered slab.

The invention further resides in the provision of a furnace, particularly a reheating furnace for slabs, billets, blooms and analogous metallic objects The furnace comprises a housing or casing which defines a plurality of discrete open-top chambers, means for individually maintaining each of the chambers at a selected temperature including burners in the casing, a mobile roof which is disposed above and is movable into sealing engagement with the casing as well as to positions in which the tops of some or all of the chambers are exposed, and elevator means for delivering objects from above into selected chambers of the casing and for lifting heated objects out of the respective chambers The furnace further comprises conveyor means for the roof, and such conveyor means is preferably disposed at a level between the roof and the elevator means.

The chambers can include pairs of neighboring first and second chambers, and the casing then includes a first sidewall or partition between a pair of first and second chambers and an additional wall for each of the first and second chambers. The partition has at least one passage communicatively connecting the respective first and second chambers and the burners are preferably provided in the additional walls which preferably face the opposite sides of the respective partition.

The roof can comprise a plurality of at least substantially coplanar neighboring sections, and the conveyor means of the furnace is then designed to move the sections relative to and/or with each other, and means (e.g., fluid-operated motors) for biasing the neighboring sections into sealing engagement with each other upon introduction of objects into the chambers of the casing. The conveyor means can comprise a plurality of wheel-mounted carriages and tracks for the wheels of the carriages. The tracks are located outside of the chambers and the marginal portions of the roof sections are preferably cooled with water or with another suitable liquid. Mats of fibrous insulating material can be interposed between the roof and the casing. The neighboring sections of the roof are preferably provided with separable tongue and groove connections. The roof can comprise a discrete section for each chamber or a common section for each pair of neighboring chambers.

The elevator means is or can comprise a wheel-mounted transporting unit and tracks for the wheels of the transporting unit. The transporting unit is preferably disposed at a level above the conveyor means for the sections of the roof.

The beds for the objects in the individual chambers of the casing can define openings so as to allow for heating of the objects from below. The beds can consist of a ceramic material or they may include metallic pipes.

The burners are preferably oriented so as to heat the marginal portions (outermost layers) of objects in the chambers, namely those layers which are most likely to have undergone pronounced or noticeable cooling on their way from the casting machine to a further processing station, e.g., into a rolling mill train.

The novel features which are considered as characteristic of the invention are set forth in particular in the appended claims. The improved reheating furnace itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 3 is a smaller-scale side elevational view of the reheating furnace;

FIG. 5 is a schematic plan view of two reheating furnaces which operate between a continuous casting machine and a rolling mill train.

DESCRIPTION OF THE PREFERRED EMBODIMENTS

Figures 1, 2:
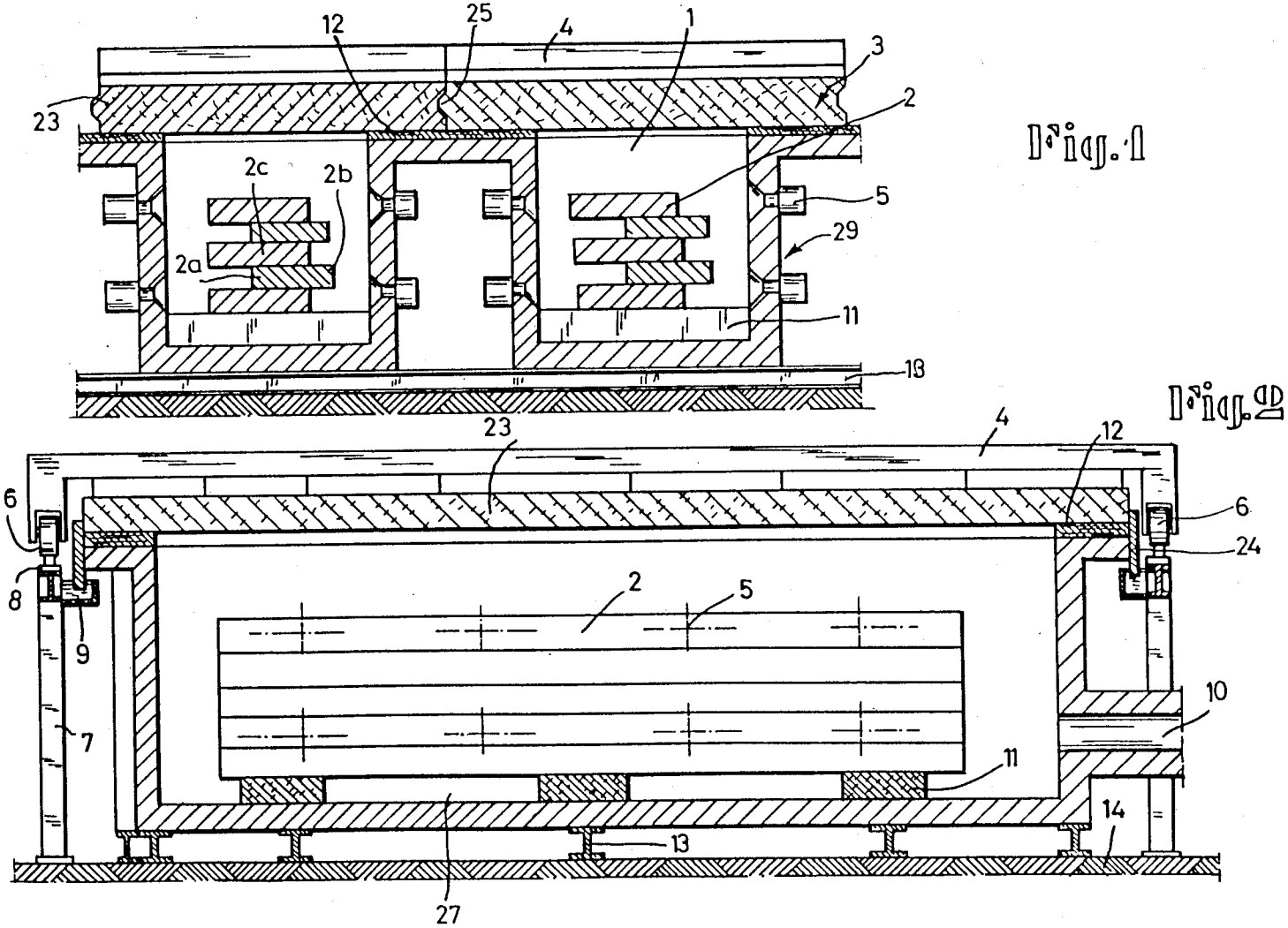
FIG. 1 is a fragmentary longitudinal vertical sectional view of a portion of a reheating furnace which embodies one form of the invention.
FIG. 2 is a transverse vertical sectional view of the reheating furnace.
Figure 6:
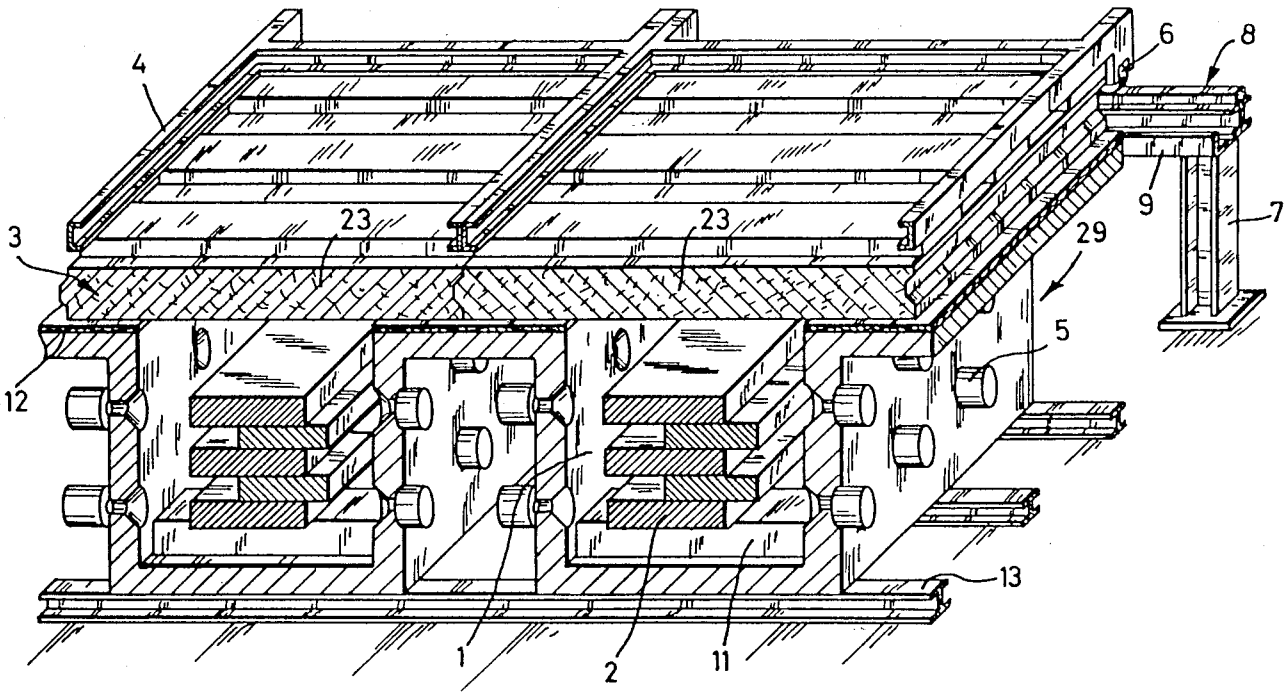
FIG. 6 is a perspective view of the structure which is shown in FIG. 1.

Referring first to FIGS. 1, 2, 3 and 6, there is shown a reheating furnace which is designed to reheat metallic objects in the form of slabs 2. As can be seen in FIGS. 1 and 6, the furnace comprises a casing or housing 29 which defines a row of discrete neighboring heating chambers 1 with beds 11 for piles or stacks of specially arrayed slabs 2. The arrangement is such that the left-hand longitudinal marginal portions of the oddly numbered slabs 2 in each pile extend laterally outwardly (to the left) and beyond the left-hand marginal portions of the neighboring evenly numbered slabs 2, and that the right-hand longitudinally extending marginal portions of the evenly numbered slabs extends laterally outwardly (to the right) and beyond the neighboring oddly numbered slabs 2. This can be said to constitute so-called running header patterns analogous to running stretcher bonds known from the art of bricklaying. Since the marginal portions of the slabs 2 are most likely to undergo pronounced or noticeable cooling during transport from a continuous casting machine (such as the machine 30 of FIG. 5) toward a rolling mill train (see the train 31 in FIG. 5), the arrays which are shown in FIGS. 1 and 6 ensure that one longitudinally extending marginal portion (2*a*) of each slab evenly numbered 2 (as counted upwardly from the respective beds 11) is heated by the median portions 2*c* of the adjacent oddly numbered slabs 2 and that the other longitudinally extending marginal portion 2*b* of each evenly numbered slab 2 can be heated by hot combustion products which are generated and directed against the marginal portion 2*b* by fuel burners 5 which are installed in the casing 29 of the reheating furnace. As a rule, the median portion 2*c* of each slab 2 is sufficiently hot to be ready for rolling when it enters a chamber 1 of the casing 29 but the marginal portions 2*a*, 2*b* require reheating so as to raise their temperature to that (e.g., to approximately 1250° C.) which is best suited for the rolling of steel The burners 5 are installed in the sidewalls of the casing 29 and are oriented or can be oriented in such a way that they direct hot gaseous products against the adjacent marginal portions 2*a* or 2*b* of stacked slabs 2 in the corresponding heating chambers 1. The burners 5 can be disposed in two or more horizontal rows or they can be distributed in another suitable way. The tops of the heating chambers 1 are open, and the furnace comprises a composite roof 3 including a plurality of neighboring plate-like sections 23. Mats 12 of fibrous heat insulating material are preferably interposed between the top surfaces of sidewalls of the casing 29 and the undersides of the roof sections 23 so as to prevent uncontrolled escape of hot gaseous fluids from the chambers 1. The sections 23 of the composite roof 3 are preferably made of a suitable ceramic material and can be transported relative to and/or with each other by a conveyor system including a plurality of discrete carriages 4 with rolling elements or wheels 6 mounted for travel along elongated tracks or ways 8 outside of the chambers 1. The tracks 8 are mounted at the upper ends of upright frame members 7 which flank the casing 29 and which further carry suitable water seals 9 for the adjacent downwardly extending longitudinal marginal portions or skirts 24 of the roof sections 23. The marginal portions 24 constitute seals between the bodies of water in the seals 9 and the corresponding lateral portions of the ceramic plate-like components of the respective roof sections 23.

The casing 29 and the frame members 7 are mounted on a foundation 14 which supports a set of profiled steel beams 13 for the lower end portions of sidewalls forming part of the casing 29. The piles or arrays of slabs 2 in the heating chambers 1 come to rest on the beds 11 which are made of a ceramic material or comprise metallic pipes (not specifically shown). The neighboring beds 11 define openings or gaps 27 which render it possible to heat the piles of slabs 2 from below.

The neighboring sections 23 of the composite roof 3 are provided with separable tongue-and-groove connections 25 (see FIG. 1) which reduce the leakage of hot gaseous fluid from the respective chambers 1. The furnace further comprises means (such as the fluid-operated motors 17 shown in FIG. 3) for biasing the neighboring roof sections 23 against each other so that the tongues of the connections 25 enter the respective grooves when the furnace is in actual use. The two motors 17 are moved apart so as to enable the carriages 4 to shift the corresponding roof sections 23 relative to each other by moving along the tracks 8 in order to expose the open top or tops of one or more selected heating chambers 1 for the purpose of lowering untreated slabs 2 into or for lifting heated slabs out of the respective chambers.

The reference character 10 denotes in FIG. 2 an outlet for evacuation of waste (cooled) gaseous fluids from the corresponding heating chamber 1. Each chamber 1 can communicate with two or more outlets 10. The manner in which the cooled fluids can be reused or otherwise processed is disclosed in the commonly owned copending patent application Ser. No. 785,777 filed Oct. 9, 1985.

FIG. 3 shows an elevator 15 which constitutes a means for lowering untreated slabs 2 into selected heating chambers 1 and which can also serve as a means for lifting treated slabs out of the respective chambers. The elevator 15 includes a wheel-mounted transporting unit whose wheels 26 can roll along horizontal tracks 20 at a level above the carriages 4 for the roof sections 23. The elevator 15 can lift slabs 2 off a conveyor of the casting machine 30 and it can lower such slabs into the chambers 1 therebelow subsequent to shifting of the corresponding roof sections 23 out of the way, i.e., out of register with the open tops of the corresponding heating chambers 1. The procedure is repeated in reverse when the heating operation is completed and the elevator 15 is to lift freshly treated slabs 2 out of the respective chambers 1 for transfer onto a conveyor of the rolling mill train 31. The motors 17 are operated to bias the neighboring sections 23 of the composite roof 3 against each other during the intervals when the burners 5 discharge hot gaseous combustion products to heat the arrays or piles of slabs 2 in the chambers 1. The operation of the motor or motors forming part of the elevator 15, of the motors 17 and/or of the motors 16 which reciprocate the carriages 4 along the tracks 8 can be programmed so that the charging of heating chambers 1, operation of the burners 5, movements of the roof sections 23, starting and stoppage of the motors 17 and lifting of heated slabs 2 out of the respective chambers 1 take place in a predetermined sequence and without any or with negligible supervision. If the dimensions of all slabs 2 are the same or do not deviate appreciably from a predetermined norm, the elevator 15 can be readily operated in accordance with a program such as to accumulate slabs into piles of the type shown in FIGS. 1 and 6, i.e., to leave selected marginal portions of the slabs 2 in the heating chambers 1 exposed for optimum exchange of heat with gaseous combustion products which are generated by the respective burners 5.

FIG. 3 shows the reciprocable or reversible motors 16 which are used to shift the carriages 4 along the tracks 8 and which preferably also serve to attach the carriages 4 to or to detach them from selected roof sections 23. For example, two motors 16 can suffice to impart movements to all of the carriages 4 so as to expose the open tops of selected heating chambers 1 to an extent which barely suffices for unimpeded admission of untreated slabs 2 into and for unimpeded lifting of freshly heated slabs 2 out of the corresponding chambers 1. The extent of movement of motors 16 with selected carriages 4 can be selected by a computer so as to ensure that the charging of chambers 1 with fresh slabs and the evacuation of slabs from the chambers can be effected in a most efficient way and with minimal losses in time. As can be seen in FIG. 3, the carriages 4 can form two groups or sets one of which is coupled to the left-hand motor 16 and the other of which is coupled to the right-hand motor 16. These motors, or at least one of these motors, will be operated to shift the corresponding group or set of carriages 4 away from the other group or set just enough to expose the top of a selected chamber 1 for introduction of a pile of untreated slabs 2 or for lifting of successive topmost slabs of a pile of freshly heated slabs out of the chamber. When the freshly emptied heating chamber 1 receives a new pile of properly arrayed slabs 2, the one and/or the other machine 16 is caused to move the corresponding group of carriages 4 in a direction to close and seal the open top of the freshly charged chamber 1 so that the corresponding burners 5 can be started for the purpose of controlled heating of slabs in the freshly charged heating chamber. The motors 17 ensure that the roof sections 23 bear against each other while the burners 5 are on.

The furnace of FIGS. 1, 2, 3 and 6 comprises a single row or file of heating chambers 1 which extends in the longitudinal direction of the tracks 8 and 20. The burners 5 can be installed in at least two sidewalls which flank a given heating chamber 1 (see FIGS. 1 and 6). These burners can be installed at a single level or at three or more different levels, depending on the number of slabs 2 in a pile and on the desired uniformity of heating of exposed marginal portions of slabs 2 in the heating chambers.

Figures 2, 4:
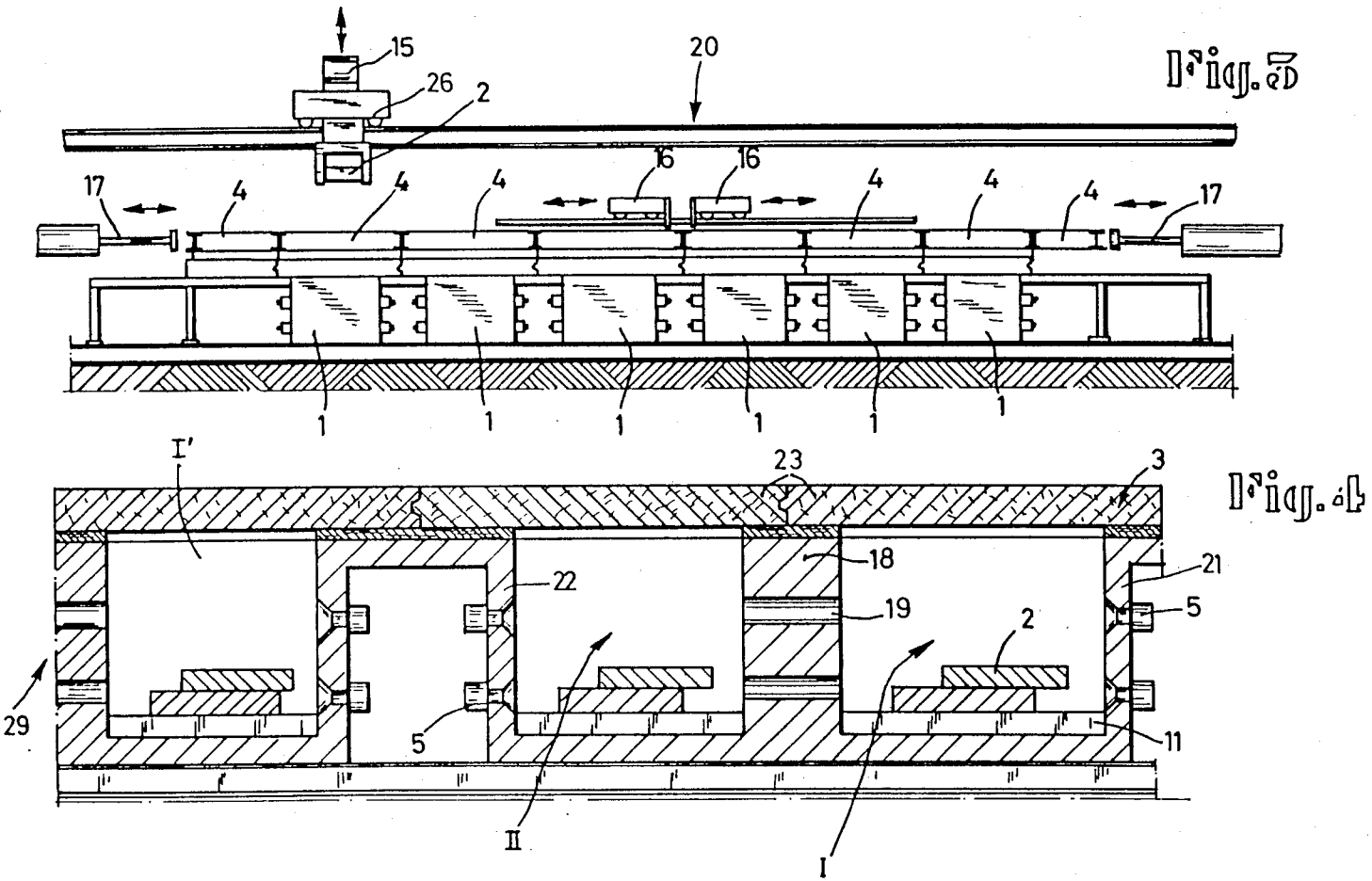
FIG. 4 is an enlarged fragmentary transverse vertical sectional view of a modified reheating furnace.
Figure 2B:
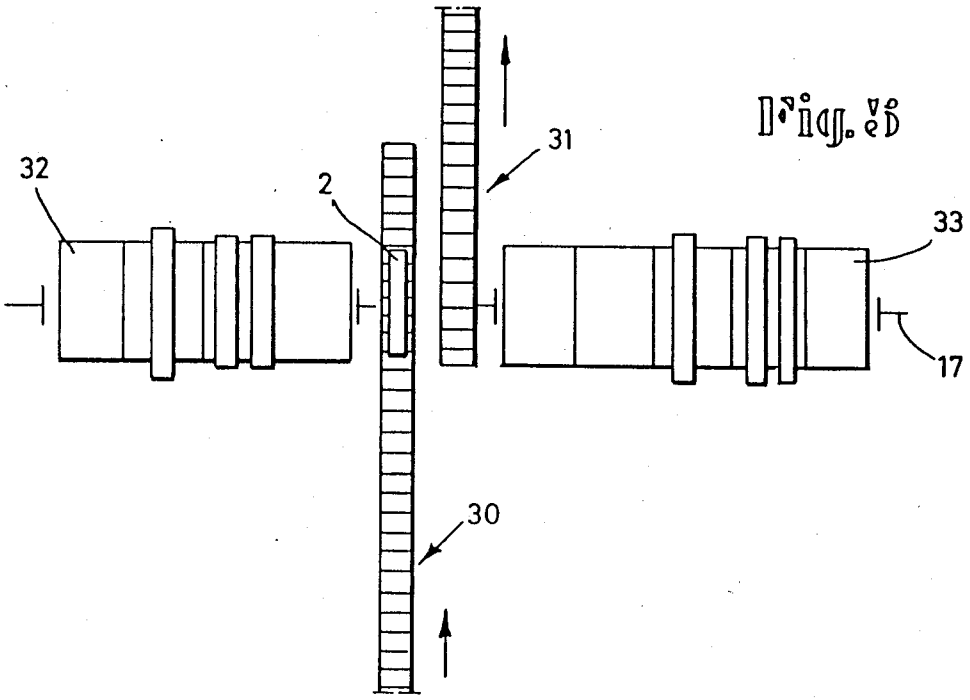

FIG. 4 shows a portion of a modified reheating furnace wherein the heating chambers are disposed in pairs. Thus, the heating chamber I is paired with the heating chamber II, and these heating chambers are separated from each other by a sidewall or partition 18 having one or more horizontal passages 19 for the flow of gaseous heating fluid between the two chambers. The burners 5 are installed in additional walls 21, 22 which face the opposite sides of the partition 18. The leftmost heating chamber I' forms one of a further pair of heating chambers. Such pairs can form one or more rows extending in the longitudinal direction of the reheating furnace, i.e., in the direction of movement of the roof sections 23 with and relative to each other. The passage or passages 19 allow for at least partial equalization of temperatures in the paired chambers I and II. The furnace of FIG. 4 is particularly suitable for reheating of relatively cold or medium hot objects with a starting temperature in the range between 700° and 1000° C.

The energy requirements of the furnace which is shown in FIG. 4 are surprisingly low. This holds particularly true if the furnace of FIG. 4 is operated in the following way: The chambers I and II of a pair of chambers are charged with piles or stacks of slabs 2 in a manner as described in connection with FIGS. 1, 2, 3 and 6. In the next step, the burners 5 in the sidewall 21 are started to discharge hot combustion products into the chamber I. Some of the partially spent or cooled combustion products flow through the passage or passages 19 and enter the chamber II. When the heating of slabs 2 in the chamber I to rolling temperature is completed, the top of the chamber I is exposed and the heated slabs 2 are lifted out of the chamber I by the elevator 15 to be replaced with a pile of fresh (untreated) slabs. The burners 5 in the sidewall 21 are arrested and the burners 5 in the sidewall 22 are started to complete the heating of slabs 2 in the chamber II to the desired rolling temperature. Some of the spent combustion products flow from the chamber II, via passage or passages 19, and into the chamber I to preheat the freshly introduced slabs 2 in the chamber I. The just described mode of reheating slabs is particularly effective and economical if the slabs which are admitted into the chambers I and II are relatively cool, i.e., well below the rolling temperature. Of course, it is also possible to operate one or more burners 5 in the sidewall 21 simultaneously with all of the burners 5 in the sidewall 22 and/or vice versa.

FIG. 5 shows that two reheating furnaces 32, 33 can be installed between a casting machine 30 and a rolling mill train 31. This renders it possible to store a substantial supply of slabs in one of the furnaces 32, 33 if the other furnace suffices to satisfy the requirements of the rolling mill train 31, or that both furnaces gather and temporarily store slabs 2 while the train 31 is idle, or that the furnaces 32, 33 consecutively or alternatively satisfy the requirements of the train 31 when the casting machine 30 is idle. The system of FIG. 5 is capable of compensating for long-lasting interruptions of normal operation of the casting machine 30 and/or rolling mill train 31, e.g., for interruptions in the range of between one hour or two or more hours. Each of the machines 30, 31 can be provided with a roller conveyor for the transport of slabs 2 to the furnaces 32, 33 and from the furnaces to the rolling mill proper.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A process for operating a furnace, particularly a reheating furnace for slabs, billets, blooms and analogous metallic objects, comprising the steps of establishing a plurality of discrete heating chambers; selecting and maintaining the temperature in each chamber independently of the other chamber or chambers; delivering objects into selected chambers from above, including stacking the objects in at least one of the selected chambers so that each upper object partly overlies the object therebelow; covering the selected chambers during heating of the objects therein; uncovering the selected chambers; and lifting the heated objects out of the respective chambers.

2. The process of claim 1, further comprising the step of delivering the objects to the chambers directly from a continuous casting machine.

3. The process of claim 1, wherein said stacking step includes arraying the objects in accordance with the running header pattern.

4. The process of claim 1 for reheating slabs of the type having longitudinally extending marginal portions, wherein said stacking step includes accumulating slabs into piles wherein one longitudinally extending marginal portion of each oddly numbered slab extends laterally outwardly beyond the one marginal portion of each adjacent evenly numbered slab and the other longitudinally extending marginal portion of each evenly numbered slab extends laterally beyond the other longitudinally extending marginal portion of each adjacent oddly numbered slab.

5. A furnace, particularly a reheating furnace for slabs, billets, blooms and analogous metallic objects, comprising a casing defining a plurality of discrete open-top heating chambers, said chambers including neighboring first and second chambers and said casing including a first sidewall between said first and second chambers and an additional wall for each of said first and second chambers, said additional walls facing the opposite sides of said first sidewall and said first sidewall having at least one passage communicatively connecting said first and second chambers; means for individually maintaining each of said chambers at a selected temperature, including burners in said casing, said burners including burners in said additional walls; a mobile roof disposed above and movable into sealing engagement with said casing as well as to positions in which the tops of said chambers are exposed; and elevator means for delivering objects from above into selected chambers and for lifting heated objects out of the respective chambers.

6. The furnace of claim 5, further comprising conveyor means for said roof, said conveyor means being disposed at a level between said roof and said elevator means.

7. The furnace of claim 5, wherein said roof comprises a plurality of substantially coplanar neighboring sections and further comprising conveyor means for moving said sections relative to and/or together with each other, and means for biasing the neighboring sections into sealing engagement with one another.

8. The furnace of claim 7, wherein said conveyor means comprises a plurality of wheel-mounted carriages and tracks for the wheels of said carriages, said tracks being disposed outside of said chambers.

9. The furnace of claim 7, wherein said sections have marginal portions and further comprising water seals for said marginal portions.

10. The furnace of claim 5, further comprising mats of fibrous insulating material between said roof and said casing.

11. The furnace of claim 5, wherein said roof comprises a plurality of discrete neighboring sections and the neighboring sections have separable tongue and groove connections.

12. The furnace of claim 11, wherein said roof comprises a discrete section for each of said chambers.

13. The furnace of claim 5, further comprising conveyor means for moving said roof relative to said casing, said elevator means including a wheel-mounted transporting unit and tracks for the wheels of said unit, said unit being disposed at a level above said conveyor means.

14. The furnace of claim 5, further comprising beds for the objects in said chambers, said beds defining openings so as to allow for heating of the objects in said chambers from below.

15. The furnace of claim 5, further comprising ceramic beds for the objects in said chambers.

16. The furnace of claim 5, further comprising beds for the objects in said chambers, said beds including metallic pipes.

17. The furnace of claim 5 for objects having marginal portions, wherein said burners are oriented to heat the marginal portions of objects in said chambers.

18. A furnace, particularly a reheating furnace for slabs, billets, blooms and analogous metallic objects, comprising a casing defining a plurality of discrete open-top heating chambers; means for individually maintaining each of said chambers at a selected tenperature, including burners in said casing; a mobile roof disposed above and movable into sealing engagement with said casing as well as to positions in which the tops of said chambers are exposed; mats of fibrous insulating material between said roof and said casing; and elevator means for delivering objects from above into selected chambers and for lifting heated objects out of the respective chambers.

19. A furnace, particularly a reheating furnace for slabs, billets, blooms and analogous metallic objects, comprising a casing defining a plurality of discrete open-top heating chambers at least some of which are arranged to receive stacks of superimposed objects so that the stacked objects exchange heat; means for individually maintaining each of said chambers at a selected temperature, including burners in said casing; a mobile roof disposed above and movable into sealing engagement with said casing during heating of objects in said chambers as well as to positions in which the tops of said chambers are exposed; and elevator means for delivering objects from above into selected chambers and for lifting heated objects out of the respective chambers.

* * * * *